United States Patent [19]

Siebring

[11] Patent Number: 4,905,453

[45] Date of Patent: Mar. 6, 1990

[54] METHOD AND APPARATUS FOR MANUFACTURING NESTED POLYETHYLENE BAGS

[76] Inventor: Barton G. Siebring, 2442 E. Collier SE., Grand Rapids, Mich. 49506

[21] Appl. No.: 222,701

[22] Filed: Jul. 21, 1988

[51] Int. Cl.[4] ..... B65B 63/04

[52] U.S. Cl. ..... 53/429; 53/119; 53/430; 493/194

[58] Field of Search ..... 53/429, 430, 120, 119, 53/118, 117, 116; 493/193, 194, 195, 196, 197, 181, 204

[56] References Cited

U.S. PATENT DOCUMENTS

| | | | |
|---|---|---|---|
| 1,947,835 | 2/1934 | Dubbs | 220/65 |
| 2,324,440 | 7/1943 | Tormohlen | 220/65 |
| 2,943,660 | 7/1960 | Seeger | 150/3 |
| 3,128,904 | 4/1964 | Reilly | 220/65 |
| 3,512,338 | 5/1970 | Nestler | 53/390 |
| 3,513,755 | 5/1970 | Nestler et al. | 493/194 |
| 3,608,712 | 9/1971 | Savole | 206/57 |
| 3,888,406 | 6/1975 | Nippes | 229/14 R |
| 3,977,152 | 8/1976 | Rochla et al. | 53/120 X |
| 4,066,174 | 1/1978 | Collins et al. | 214/7 |
| 4,142,345 | 3/1979 | Porter, Jr. | 53/54 |
| 4,182,462 | 1/1980 | Buff, Jr. | 220/450 |
| 4,227,362 | 10/1980 | Wallsten | 53/447 |
| 4,384,439 | 5/1983 | Brown | 53/378 |
| 4,472,923 | 9/1984 | Herrington | 53/429 |
| 4,481,006 | 11/1984 | LaFleur et al. | 493/194 |
| 4,545,714 | 10/1985 | Johnson et al. | 414/30 |
| 4,550,820 | 11/1985 | Bishop | 198/389 |
| 4,577,778 | 3/1986 | Kim | 220/404 |
| 4,601,154 | 7/1986 | Ausnit | 53/119 |
| 4,648,770 | 3/1987 | Berz et al. | 414/30 |
| 4,706,440 | 11/1987 | Bittner | 53/438 |

*Primary Examiner*—James F. Coan

*Attorney, Agent, or Firm*—Price, Heneveld, Cooper, DeWitt & Litton

[57] ABSTRACT

A method and apparatus for manufacturing nested polyethylene bags utilizes a web of polyethylene material having a tubular cross-sectional configuration which is fed through seaming means to form a seam transverse the web. Material transporting means transports the seamed web onto a generally planar mandrel. Severing means are provided for severing the web into individual bags and includes means for separating the walls of the web to accommodate the material transporting means grasping the web. After a predetermined number of individual bags are nested on the mandrel, the mandrel is indexed to a position adjacent a rolling means which rolls the batch of nested bags into a roll on a pair of mutually rotating wrapping rods. The wrapping rods are subsequently withdrawn from the roll and the roll is folded along a longitudinal axis by a ram which applies a force to the center of the roll.

48 Claims, 16 Drawing Sheets

METHOD AND APPARATUS FOR MANUFACTURING NESTED POLYETHYLENE BAGS

BACKGROUND OF THE INVENTION

This invention relates to a method and apparatus for manufacturing and packaging polyethylene bags that are individually nested inside of each other.

Polyethylene bags, which are sealed on three ends and open on the fourth end, are conventionally manufactured from a tube of polyethylene sheet. A seam is made transverse the web of polyethylene tubing at predetermined lengths in order to form the bottom of each bag. The tubing is typically perforated adjacent the seam in order to allow the individual bags to be separated. A predetermined count of bags produced in this manner is then rolled onto a core and inserted within a dispensing box or the like.

The most noted use for such bags is as trash can liners but they also find use in other applications. The difficulty with polyethylene bags manufactured in this conventional manner, is that the bags must be individually separated from the roll, opened and then pushed down inside a rigid container, such as a garbage can. This method is difficult and time-consuming, which explains why polyethylene bags have not found a greater acceptance in applications such as in bagging merchandise at a store check-out counter.

One approach to making polyethylene bags easier to use, and hence more widely accepted, is to supply the bags nested within each other in a predetermined quantity. In this manner, the batch of bags can be inserted at one time into the rigid container and, as each bag becomes full, the bag may be retracted from the batch. The next of the remaining bags is immediately ready for use. Because polyethylene has a low coefficient of friction, the bags slide well with respect to each other and are easy to withdraw from the container.

The reason that nested polyethylene bags have not received wide-scale acceptance has been the difficulty in manufacturing such bags. Accordingly, it is an object of the present invention to provide a method and apparatus for manufacturing nested polyethylene bags that is both inexpensive and reliable in operation. It is a further object of the present invention to provide such a method and apparatus that produces nested polyethylene bags in a neat package which is easy to handle and install in a rigid container.

SUMMARY OF THE INVENTION

Nested polyethylene bags are manufactured according to the invention by feeding polyethylene tubing from a roll, placing a seam transverse the tubing and shearing the web adjacent the seam. The formed bag is expanded and pulled onto a mandrel over bags that have already been placed on said mandrel. When a predetermined number of bags are accumulated on the mandrel, the batch of bags is removed from the mandrel, the end of the batch of bags is turned to form the batch into a roll and the roll is then simultaneously folded and moved to a position adjacent a container by applying a force to the center of the roll.

These and other related objects, advantages and features of this invention will become apparent upon review of the following specification in conjunction with the drawings.

DESCRIPTION OF THE PREFERRED EMBODIMENT

Referring now specifically to the drawings, and the illustrative embodiments depicted therein, an apparatus for manufacturing nested polyethylene bags generally shown at 40 includes a material feeding station 42, a bag nesting system generally shown at 44 and a bag wrapping and folding system generally shown at 46, positioned below the bag nesting system.

Figure 2:
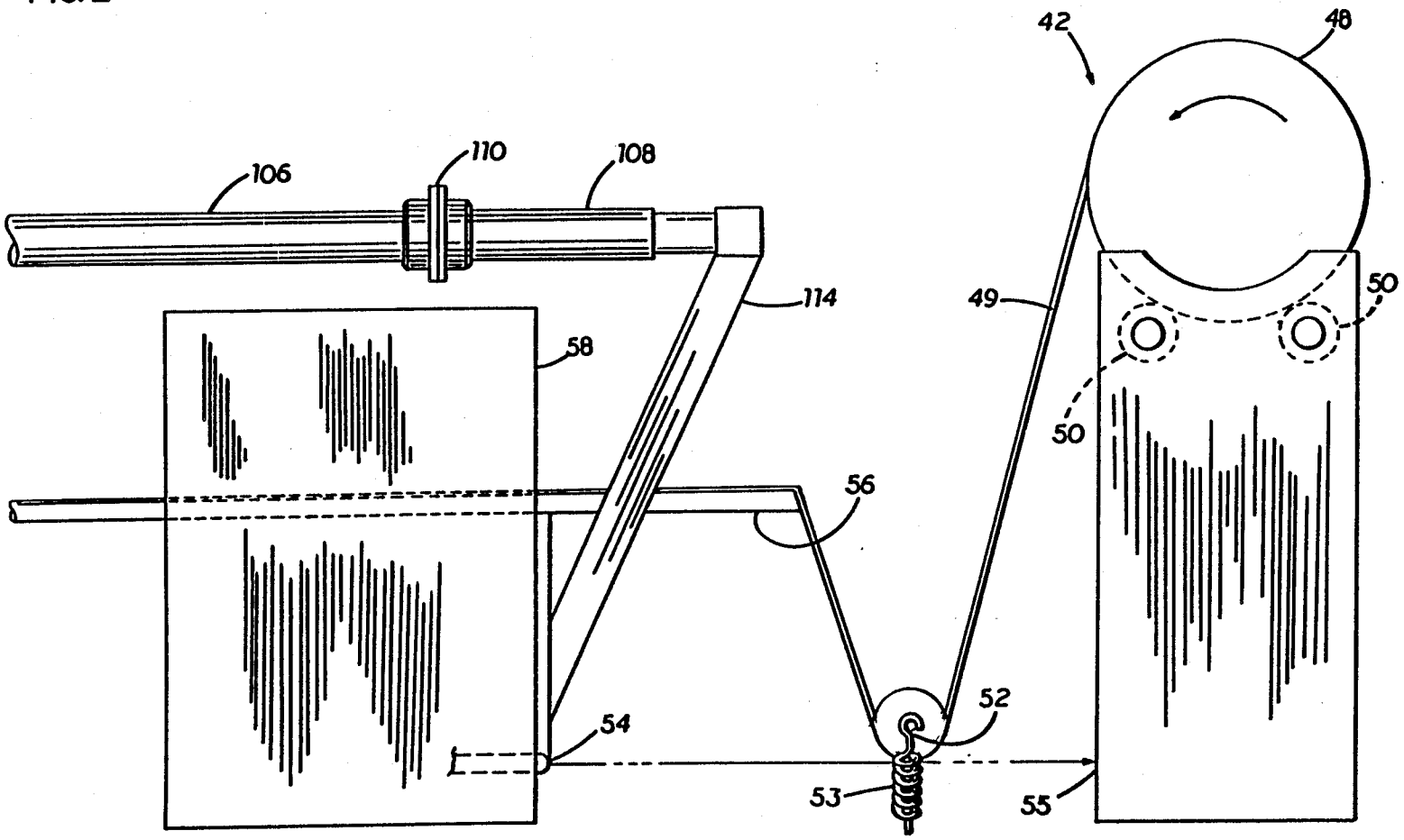
FIG. 2 is a side elevational view of the material unrolling and sealing portion of the bag nesting system.

Feed stock for the system, which includes polyethylene tubing of any desired thickness and width, is supplied on a roll 48. Roll 48 is positioned upon a pair of powered rollers 50 which rotate roll 48 at an appropriate rate to keep the polyethylene tubing 49 under constant tension. This is accomplished by looping tubing 49 under a downwardly-biased spring-tensioned roller 52 and by providing a photocell 54 whose beam is reflected back by reflector 55 and is broken whenever the web of tubing 49 is moved downwardly, under the force of spring 53 and against the tension of tubing, past a predetermined point (FIG. 2). Powered rollers 50 are driven whenever the beam from photocell 54 is not interrupted and are not powered when the light beam is interrupted. In this manner, material is paid out from roll 48 at a rate sufficient to maintain spring-tension roller 52 within a controlled position which maintains a predetermined tension on tubing material 49.

Tubing material 49 extends upwardly from spring roller 52 and horizontally traverses the top of a table 56. In traversing table 56 from right-to-left, as viewed in FIG. 2, tubing 49 passes through a seaming machine 58 which is capable of sealing the width of tubing material 49 in order to create the bottom seam in a garbage bag, as is known in the art. Seaming machine 58 is commercially available and is manufactured under Model No. 24PS by Vertrod Corp.

After passing through the interior of seaming machine 58, flat tubing material 49 is sheared into a predetermined length by cutting and suction assembly 60 (FIGS. 2*a* and 3–6). Cutting and suction assembly 60 is positioned under a bracket 66 and includes a suction bed 62 horizontally in line with table 56 and a pair of vertically upright guide pins 64 positioned at opposite lateral ends of suction bed 62. A movable assembly 68 is mounted to guide pins 64 in a manner that provides vertical reciprocating movement of the assembly 68 on guide pins 64. Assembly 68 is vertically reciprocated by an air cylinder 70 mounted to a top portion of bracket 66.

Figure 7:
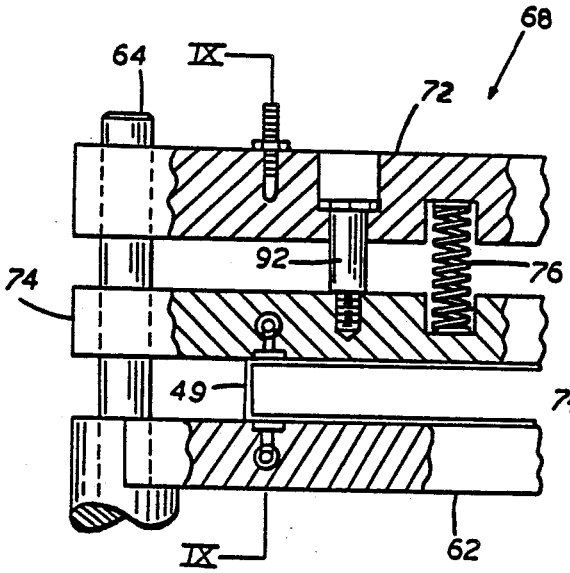
FIG. 7 is an enlargement of the portion of FIG. 5 designated VII with the knife and a portion of the other members removed.
Figure 8:
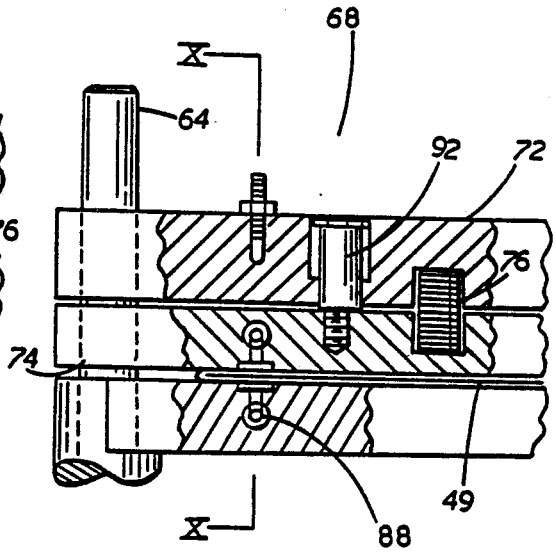
FIG. 8 is the same as FIG. 7 in a different portion of the cycle.
Figure 9:
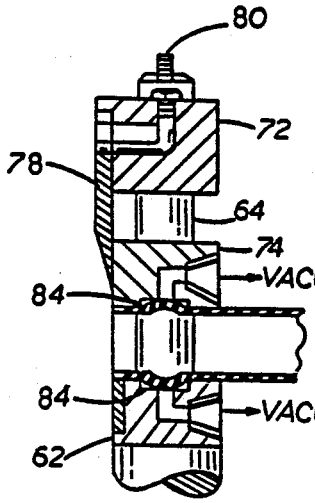
FIG. 9 is a sectional view taken along the line IX—IX in FIG. 7.
Figure 10:
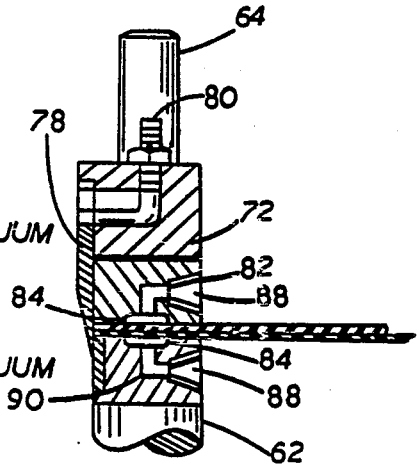
FIG. 10 is a sectional view taken along the line X—X in FIG. 8.

Movable assembly 68 includes an upper cutter bar 72 and a lower suction bar 74 interconnected by a pair of compression springs 76 and secondary guide pins 92 (FIGS. 7 and 8). A cutting knife 78 is mounted to a face of cutter bar 72 by a plurality of L-shaped mounting bolts 80 (FIGS. 9 and 10). Suction bar 74 is perforated by a plurality of vacuum cavities 82 laterally spaced apart along the suction bar. Each cavity 82 is lined by an O-ring 84 which is positioned to be essentially flush with the lower horizontal surface 86 of suction bar 74 to form a seam with tubing 49. Each vacuum cavity 82 is interconnected with a controlled vacuum line (not shown) through a passage 88. A plurality of spaced-apart vacuum cavities 90 are provided in suction bed 62 in vertical alignment with cavities 82 in suction bar 74. Each vacuum cavity 90 includes an o-ring 84 and vacuum passage 88. Cutter bar 72, suction bar 74 and suction bed 62 are maintained in vertical alignment by guide pins 64. Additional alignment is provided between the cutter bar and suction bar by secondary guide pins 92.

Figure 2A:
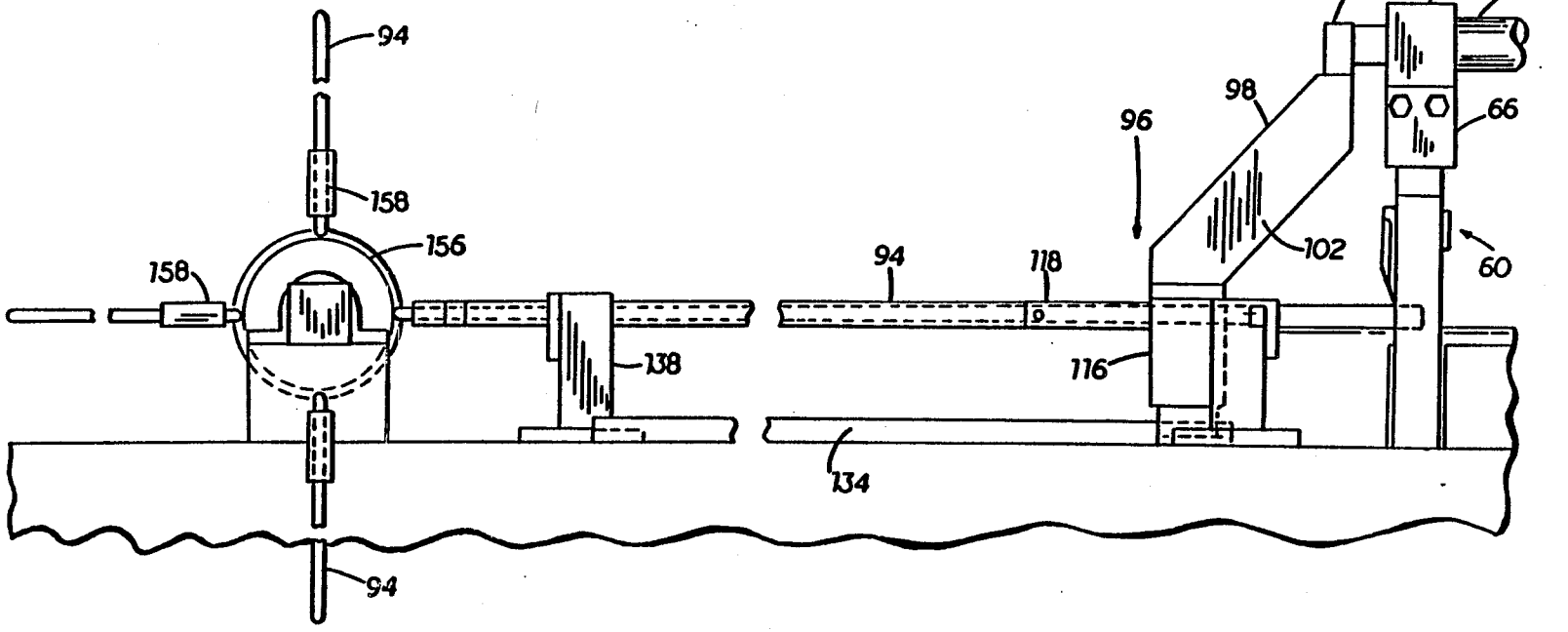
FIG. 2*a* is a side elevational view of the shearing and bag transport portion of the bag nesting system and is a continuation of FIG. 2.
Figure 3:
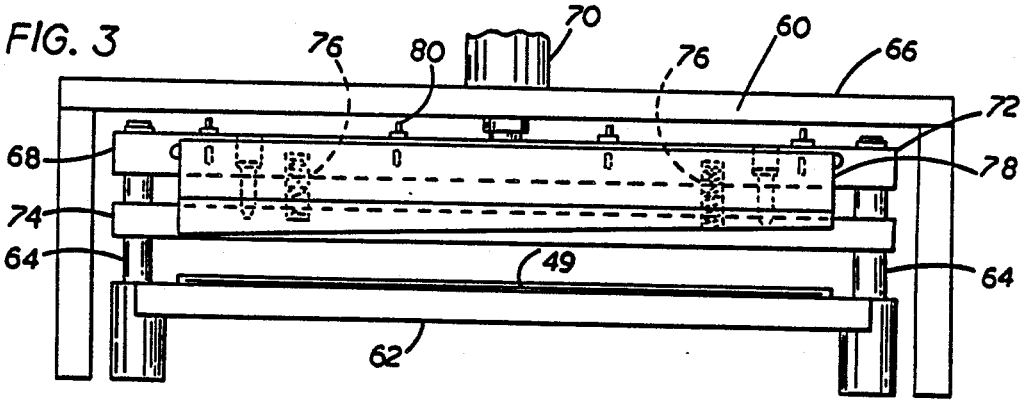
FIGS. 3–6 are elevational views of the combination cutting and suction mechanism in various portions of its cycle.
Figure 4:
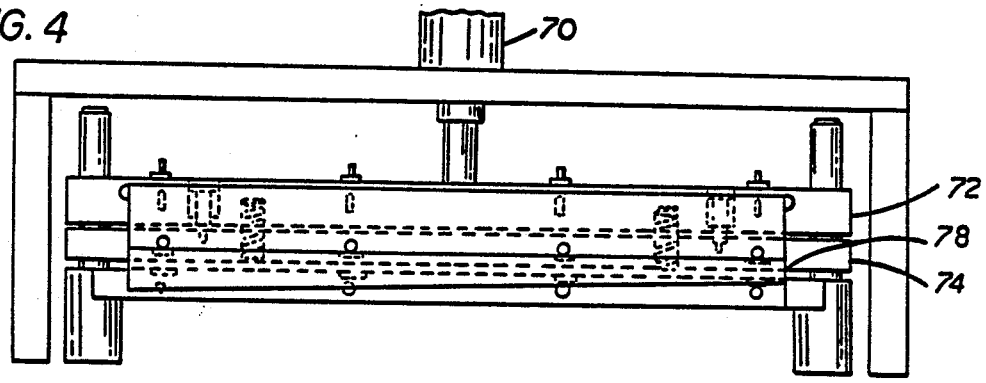
Figure 5:
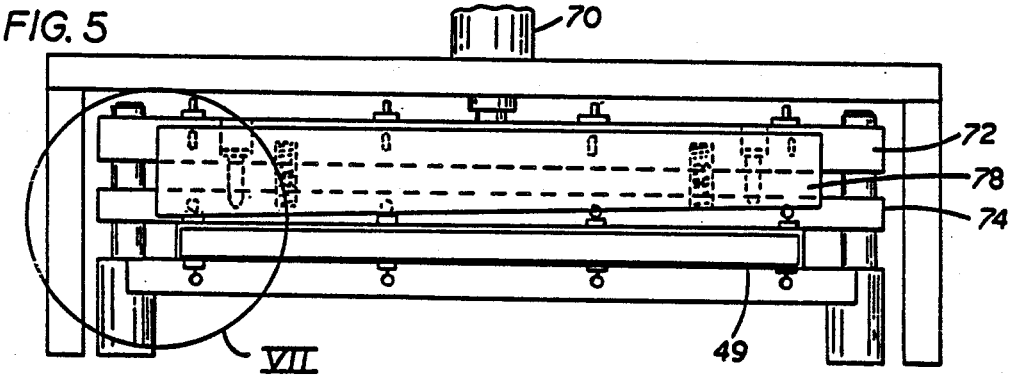

Cutting and suction assembly 60 operate to sever the tubing material 49 at a predetermined distance from the seam placed across the tubing by seaming machine 58 and to separate the walls of tubing 49 to accommodate movement onto a mandrel 94 (FIG. 2*a*). When pneumatic cylinder 70 is extended, movable assembly 68 is forced downwardly causing suction bar 74 to engage the upward-facing surface of tubing 49. As assembly 68 is moved further downwardly, springs 76 are compressed and knife 78 shears tubing 49, as seen in (FIGS. 4 and 10). With movable assembly 68 in the downwardmost position illustrated in FIGS. 4 and 10, a vacuum is drawn on passages 88 which causes the upper wall of tubing 49 to adhere to suction bar 74 and the lower wall of tubing 49 to adhere to suction bed 62. As cylinder 70 is retracted, as illustrated in FIGS. 5 and 9, the upper and lower walls of tubing 49 are separated by the relative movement between the suction bar and bed.

Figure 6:
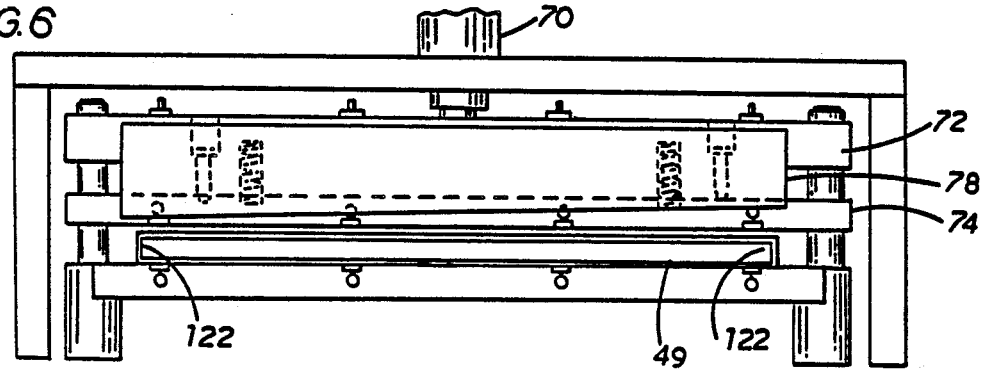

With the walls of tubing 49 separated, the tubing is moved onto mandrel 94 by a bag transporting mechanism, generally shown at 96, having laterally spaced fingers 122 for grasping the inside of the lateral ends of tubing 49 which has been opened as seen in FIG. 6. Transport mechanism 96 includes a yoke 98 having a horizontal bar 100 and a pair of downwardly-extending arms 102 on laterally opposite ends of bar 100. A finger assembly 104 is mounted to the lower extreme of each arm 102. Yoke 98 is longitudinally moved by a pair of aligned, back-to-back cylinders 106 and 108 (FIGS. 2 and 2*a*). The forward, outer portion of cylinder 106 is supported, in a manner that allows the longitudinal movement, by a slide 105 attached to bracket 66 and is attached at its rear portion to a forward portion of cylinder 108 at coupling 110. The rearward, outer portion of cylinder 108 is not supported but the movable piston 112 is supported by a stationary bracket 114.

Finger assembly 104 includes a carriage 116 attached to a lower portion of the respective arm 102, a cam bar 118 pivotally connected to carriage 116 by pivot means 120, a finger member 122 rigidly connected to and parallel with cam bar 118 by an L-shaped bracket 124 and a biasing spring 123 between bracket 124 and carriage 116. In this manner, as cam bar 118 pivots about pivot means 120, the distal end of finger 122 moves laterally inwardly and outwardly with respect to the tubing material 49. Each carriage 116 is longitudinally movable along a track 134 through the movement of arms 102 of yoke 98. Bag transport mechanism 96 further includes stationary cam actuators 126 and 128 for actuation of each finger assembly 104. Each cam actuator 126 and 128 includes an unidirectional, pivotally mounted strike member 130 and biasing means 132 for biasing mounted strike member 130 and biasing means 132 for biasing the strike member in a position perpendicular the movement of carriage 116.

Figures 12, 13, 14, 15:
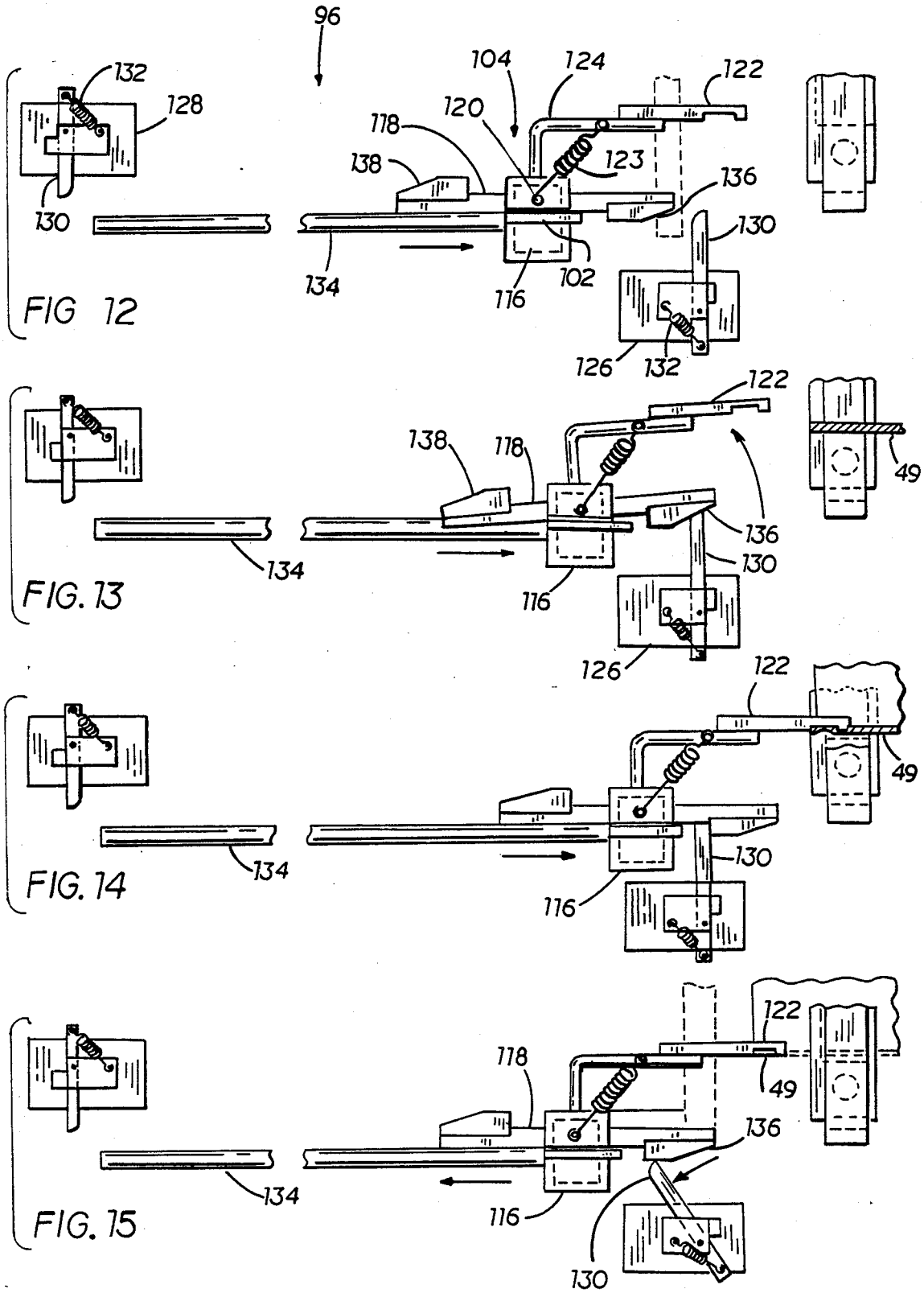
FIGS. 12–19 illustrate the bag transporting portion of the bag nesting system in various portions of its cycle.

A description of the operation of bag transport mechanism 96 in transporting tubing 49 from its position between cutting/suction assembly 60 and onto a mandrel 94 will now be explained with reference to FIGS. 12–19. With the upper and lower walls of tubing 49 separated by cutting and suction assembly 60, as seen in FIGS. 5 and 9, carriages 116 are moved toward the cutting and suction assembly as illustrated in FIGS. 12–14. As a first cam surface 136 of cam bar 118 contacts strike 130, which is inhibited from clockwise rotation, cam bar 118 is pivoted about pivot means 120 in a manner to cause fingers 122 to move toward each other, or inwardly. This allows the fingers to move inside the tubing 49, as seen in FIGS. 6 and 13. Further movement of carriages 116 in this direction, causes cam surface 136 to move beyond strike member 130 which allows cam bar 118 to return to its normal position, under the bias of spring 123, and fingers 122 to move outwardly into engagement with the lateral walls of tubing 49, as seen in FIG. 14.

Figure 16:
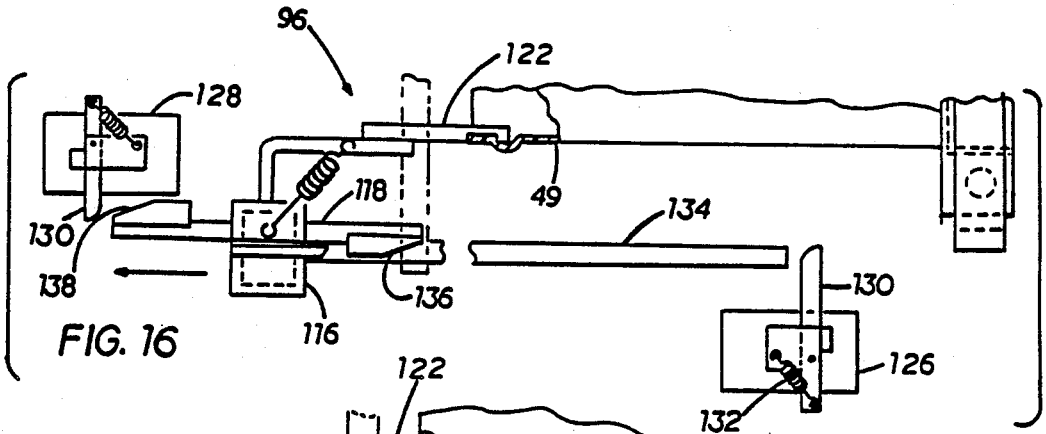
Figure 17:
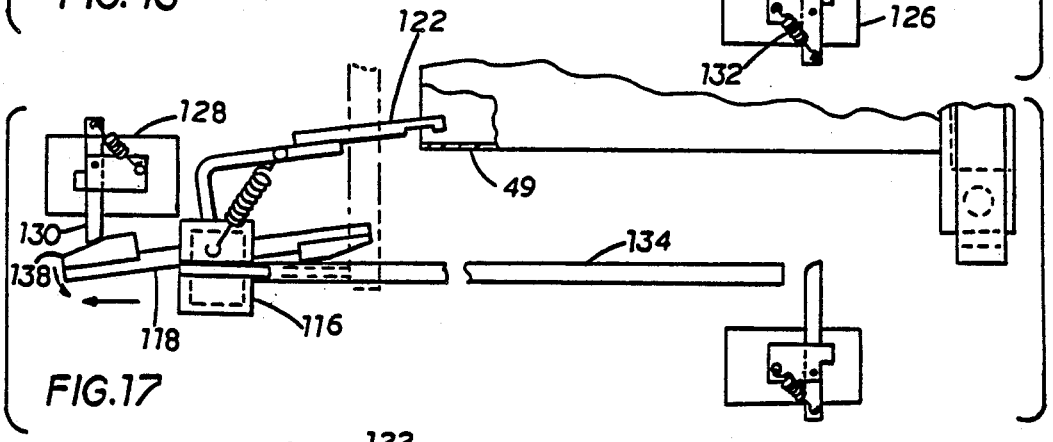
Figure 18:
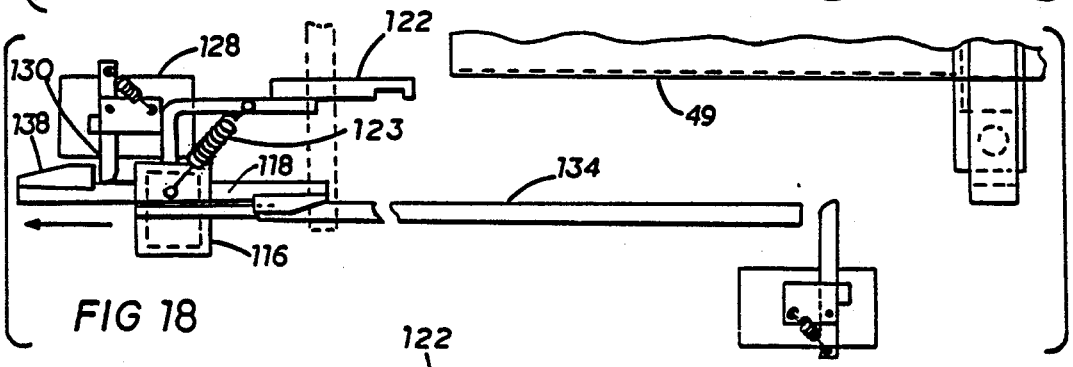
Figure 19:
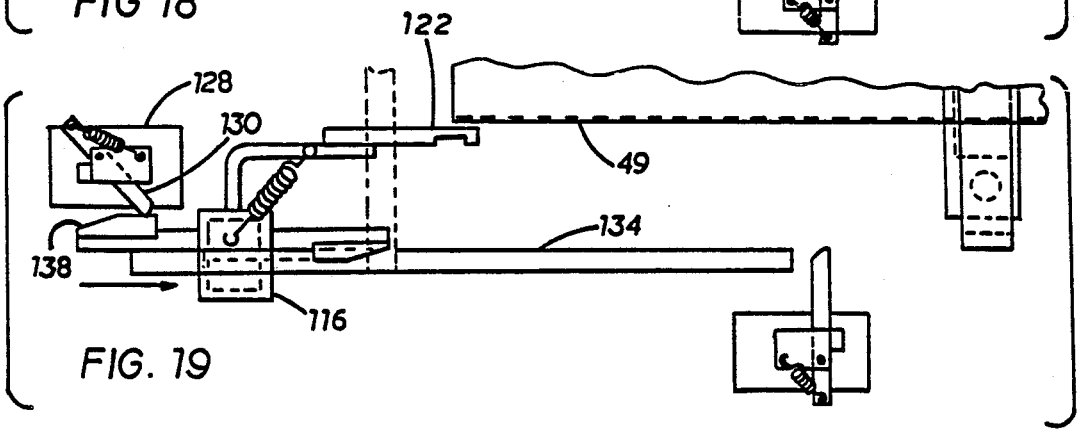

Carriages 116 are now moved in the opposite direction, to the left, as seen in FIGS. 15–18 transporting tubing 49, which is still attached to the web of material. Thus, the transport mechanism not only moves bags onto mandrel 94, but also advances the material web. When first cam surface 136 engages strike member 130 as carriage 116 moves to the left, as seen in FIG. 15, strike member 130 pivots out of its way without causing cam bar 118 to pivot. Further movement to the left of carriage 116, as seen in FIG. 16, causes first cam surface 136 to clear strike member 130 which is returned to its normal position by biasing means 132. As carriage 116 moves further to the left, a second cam surface 138 engages strike member 130 of cam actuator 128. This causes cam bar 118 to once again pivot in a manner to cause fingers 122 to move toward each other, as seen in FIG. 17, to release the grip on tubing 49. As carriage 116 moves further to the left, as seen in FIG. 18, second cam surface 138 clears strike member 130 which allows cam bar 118 and fingers 122 to return to their normal position under the bias of spring 123. Because tubing 49 is laterally stretched somewhat as it is pulled onto mandrel 94, once it is released it returns to its original configuration which is laterally inside of the position of finger 122, as seen in FIG. 18. Thus, as carriage 119 is again moved to the right, as seen in FIG. 19, fingers 122 will clear the outer lateral edge of tubing 49. Tubing 49, having a seamed end, is now positioned on mandrel 94. Cylinder 70 is then extended to shear the tubing just below the seam.

Figure 11:
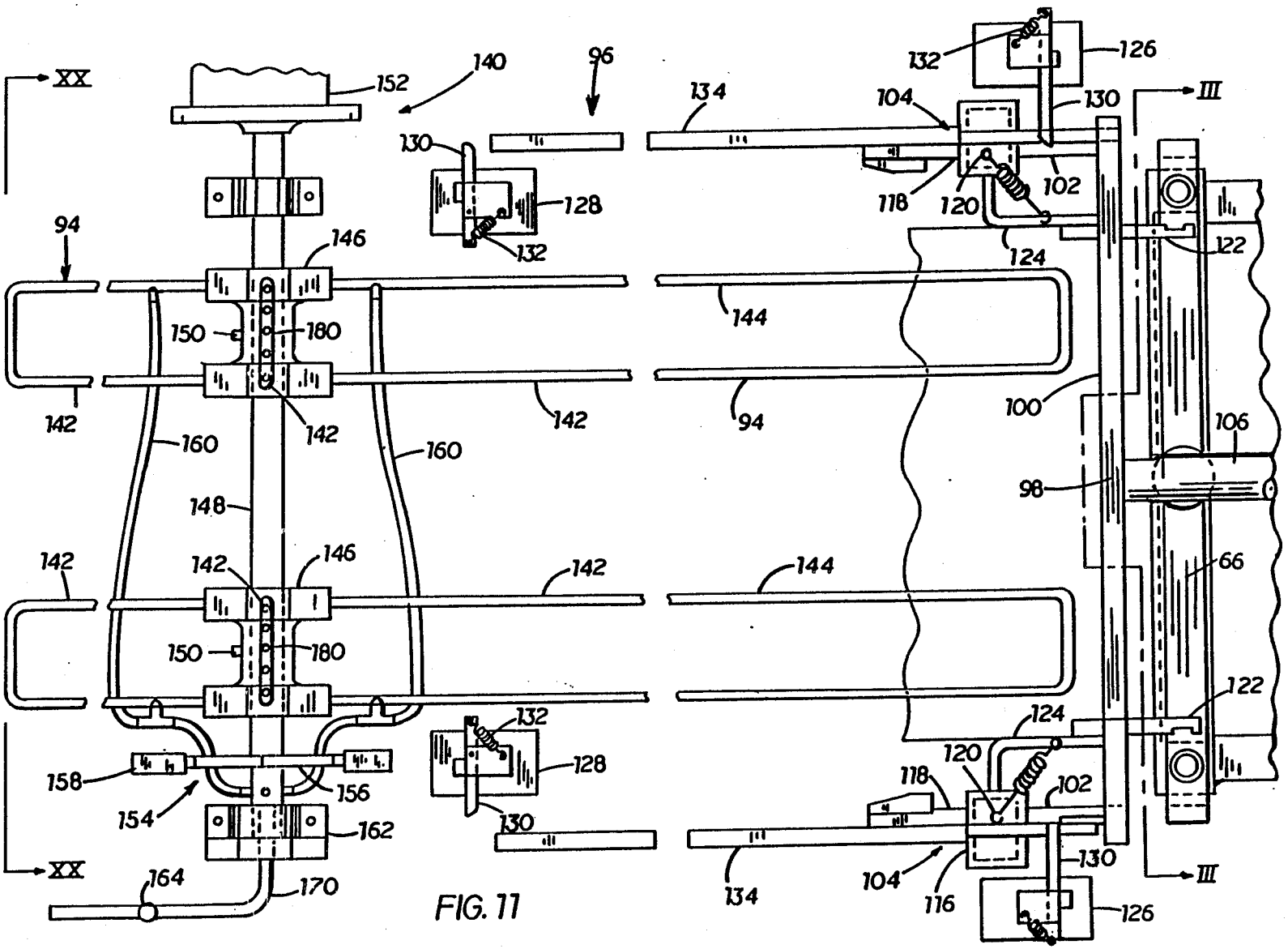
FIG. 11 is a plan view of the nesting portion of the bag nesting system.

Yoke 98 is longitudinally moved, in order to slide carriages 116 along tracks 134, by the operation of cylinders 106 and 108. With cylinders 106 and 108 fully retracted, yoke 98 is adjacent cutting and suction assembly 60, as seen in FIGS. 11 and 14. To pull the tubing 49 onto mandrel 94, the longer of the two back-to-back cylinders, 106, is extended. This pulls the tubing from its position between the cutting/suction assembly 60 and seaming machine 58 to a position where the upstream seam is immediately beyond the cutting and suction assembly. Air cylinder 70 is then actuated to shear the tubing 49 to separate the completed bag from the upstream tubing web. At this point in the machine cycle, bag transport mechanism 96 still has a grip on the completed bag 49 and is approximately in a position seen in FIG. 16. The extension of cylinder 108 draws the completed bag further onto the mandrel. The purpose of this additional movement is to move the severed portion of the completed bag away from the cutting and suction assembly 60 so that the assembly of nested, completed bags does not interfere with operation of the cutting and suction assembly. It is to be understood that back-to-back cylinders 106 and 108 could be replaced by a single cylinder having controllable, discrete extension lengths.

Once the completed bag is moved onto the mandrel 94, the cycle repeats with bag transport mechanism 96 returning to the position seen in FIGS. 11 and 14 to grasp the next portion of the tubing 49, which has been laterally seamed further up the web by seaming machine 58 to form a complete bag, and then moving this next bag, which is still attached to the material web, over the completed bags on mandrels 94. Thus, the repetition of this cycle produces and nests on mandrel 94 a plurality of completed polyethylene bags.

Figure 1:
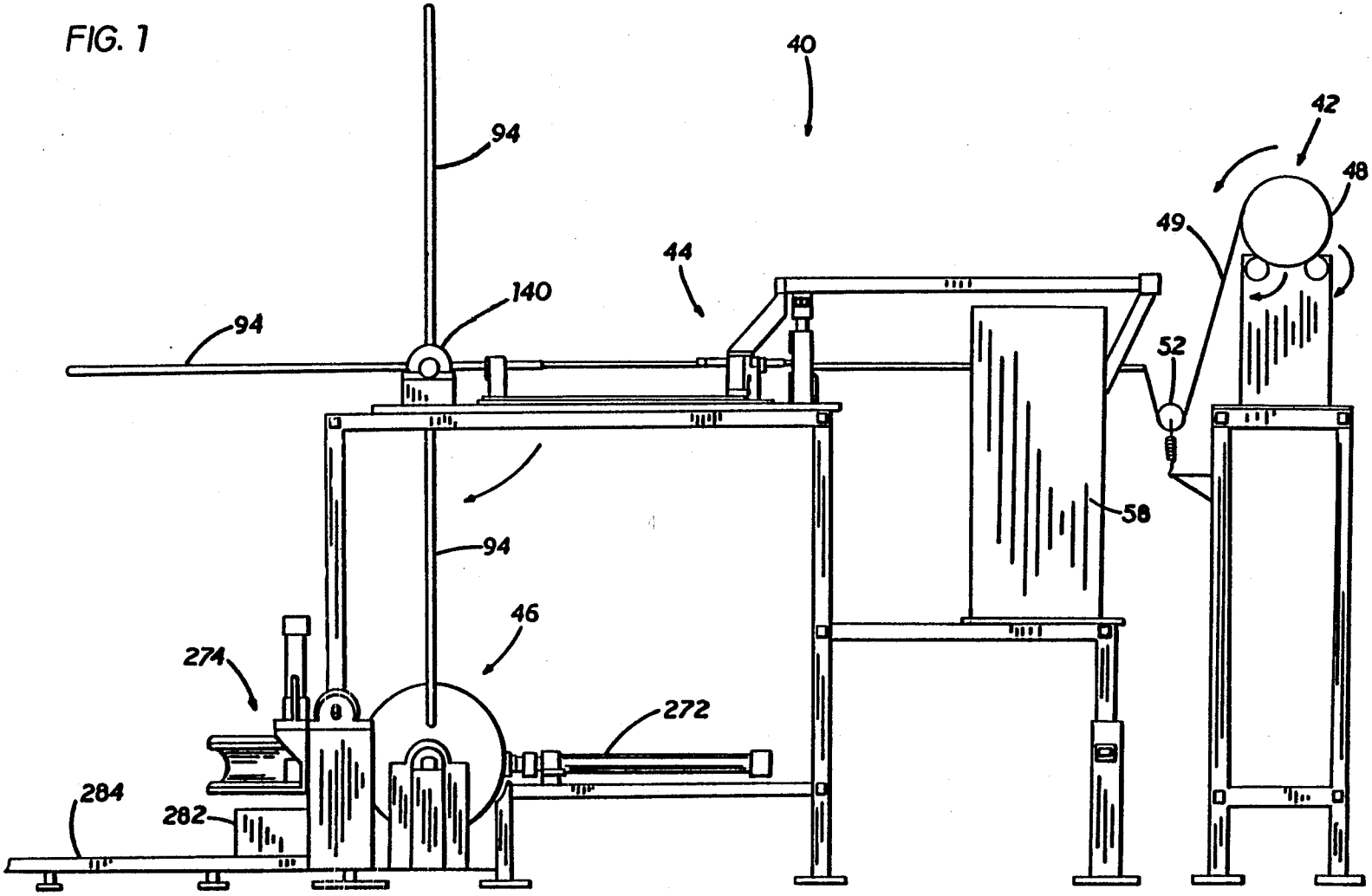
FIG. 1 is a side elevational view of a nested polyethylene bag manufacturing apparatus.

After the bag nesting system has cycled through a predetermined number of operations, for example 36, it is momentarily disabled for removal of the batch of bags from the mandrel. In order to remove the batch of bags, indexing means, generally shown at 140, is operated to index the mandrel 94, to which the batch of bags have been nested, from a horizontal position to a downwardly extending, vertical position adjacent the bag wrapping and folding system 46 (FIG. 1). The operation of indexing means 140 additionally positions another mandrel 94 into a horizontal position in the bag nesting system 44 for loading with bags. In the illustrated embodiment, four mandrels 94 are spaced apart at 90° and indexing means 140 moves all of the mandrels through a 90° angle, when actuated.

Figure 20:
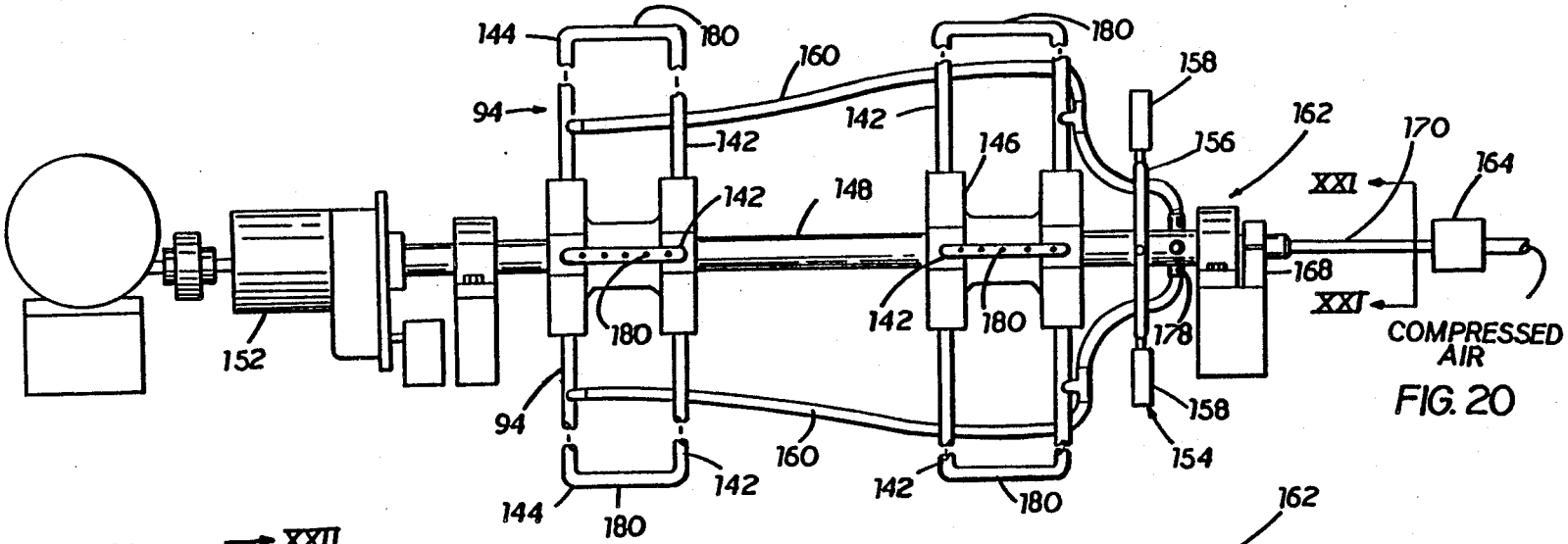
FIG. 20 is an elevational view taken along the lines XX—XX in FIG. 11.

Each mandrel 94 includes a pair of mandrel sections 142 defined by a hollow U-shaped tubing member 144 connected to a mounting bracket 146 (FIGS. 11 and 20). Mounting brackets 146 are rigidly attached to a mandrel axle 148 and provide means for mounting the tubing members 144 for all mandrels 94 to the axle. Mounting screws 150 rigidly engage mounting brackets 146 with mandrel axle 148 and, when loosened, provide adjusting means for allowing adjustment of the axial spacing between mounting brackets 146 to accommodate various widths of tubing 49.

Indexing means 140, in the illustrated embodiment, includes an electric motor/clutch/brake assembly 152 and angle monitoring means generally shown at 154. Monitoring means 154 includes a timing disk 156 and one or more microswitches 158 actuated by indentations in timing disk 156. Each time motor 150 is energized, mandrel axle 148 is rotated, which causes the actuators of switches 158 to move from the indentations in disk 156. Motor 152 is energized until the next set of indentations engage the actuators of switches 158 which, in turn, causes motor 152 to be deenergized. The indexing means could alternatively include a rack and pinion gear, with a one-way ratchet clutch, and a linear cylinder actuator.

Figure 22:
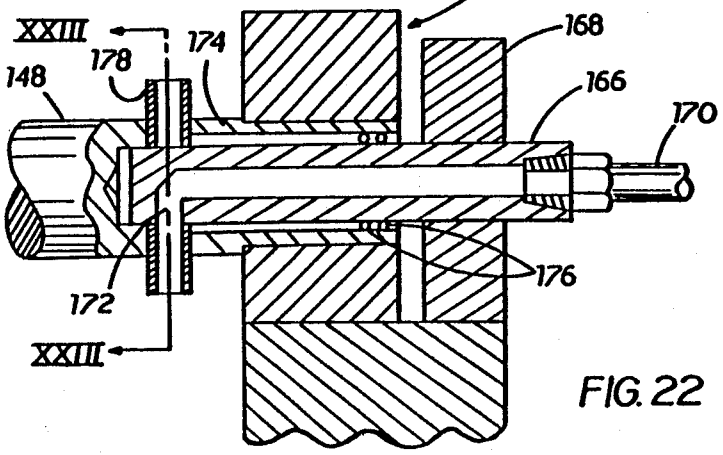
FIG. 22 is a sectional view taken along the lines XXII—XXII in FIG. 21.
Figure 23:
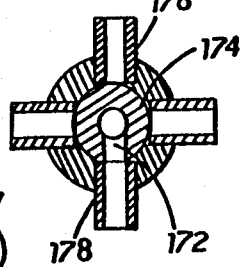
FIG. 23 is a sectional view taken along the lines XXIII—XXIII in FIG. 22.
Figure 21:
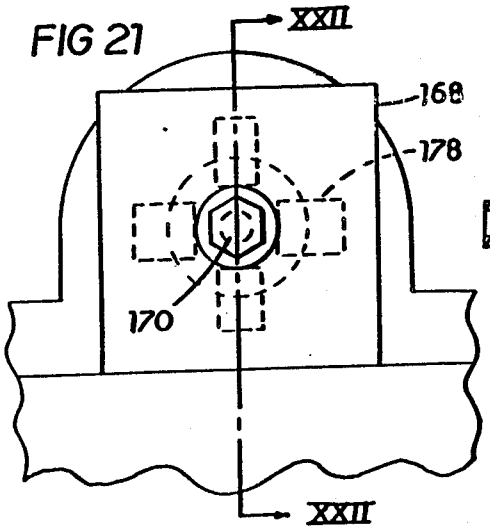
FIG. 21 is an elevational view along the lines XXI—XXI in FIG. 20.
Figure 24:
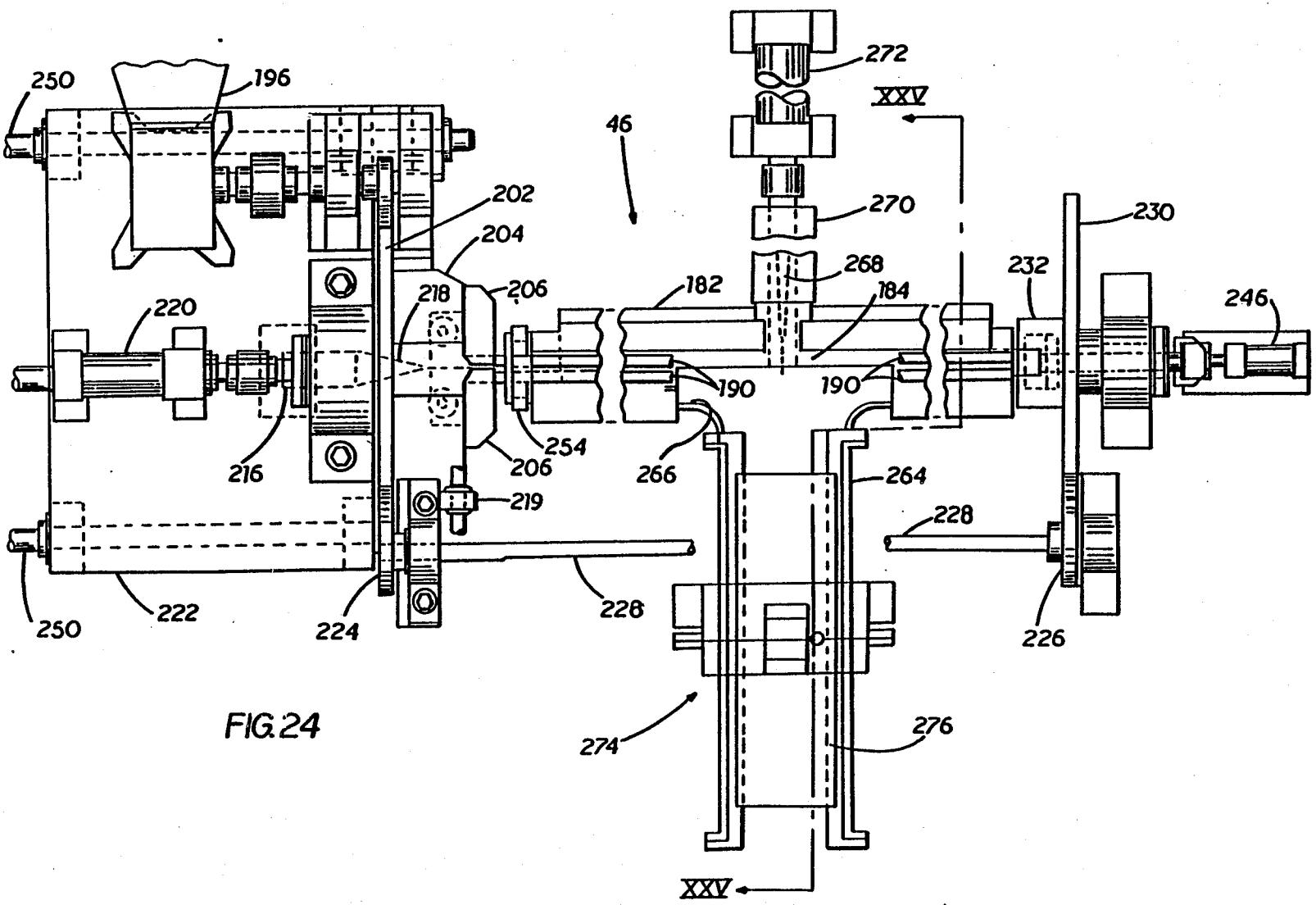
FIG. 24 is a plan view of the bag wrapping and folding system.

The inner passages of mandrel tubing members 144 are interconnected through flexible tubes 160, a slip coupling 162 and a solenoid valve 164 to a source of compressed air (not shown). Slip coupling 162 includes a stationary tube 166 mounted to a support 168 and connected to valve 164 by tubing 170. Tube 166 has an internal bore that terminates inwardly at a right angle port 172 (FIGS. 22 and 23). The lateral end of mandrel axle 148 includes a drilled cavity 174 which rotatably receives stationary tube 160. A pair of O-rings 176 seal the interface between tubing 166 and cavity 174. A plurality of nipples 178 are spaced around axle 148 and extend into cavity 174. Each nipple 178 provides an interconnection between cavity 174 and the flexible tube 160 connected to its respective mandrel 94. After indexing means 140 rotates axle 148, port 172 is caused to align with one of the nipples 178. This pneumatically connects tubing 170 with the flexible tubing 160 associated with the particular mandrel that is downwardly vertically extending. When the angle monitoring means 154 indicates that the mandrels have been indexed 90°, solenoid valve 164 is momentarily opened to feed compressed air to the tubing members 140 of the downwardly vertically extending mandrel connected therewith by slip coupling 162. This causes compressed air to be ejected through a plurality of jets 180 located on the distal end of tubing members 140 which, in addition to gravity, causes the nested batch of bags to be ejected from the downwardly vertically extending mandrel 94.

Figure 25:
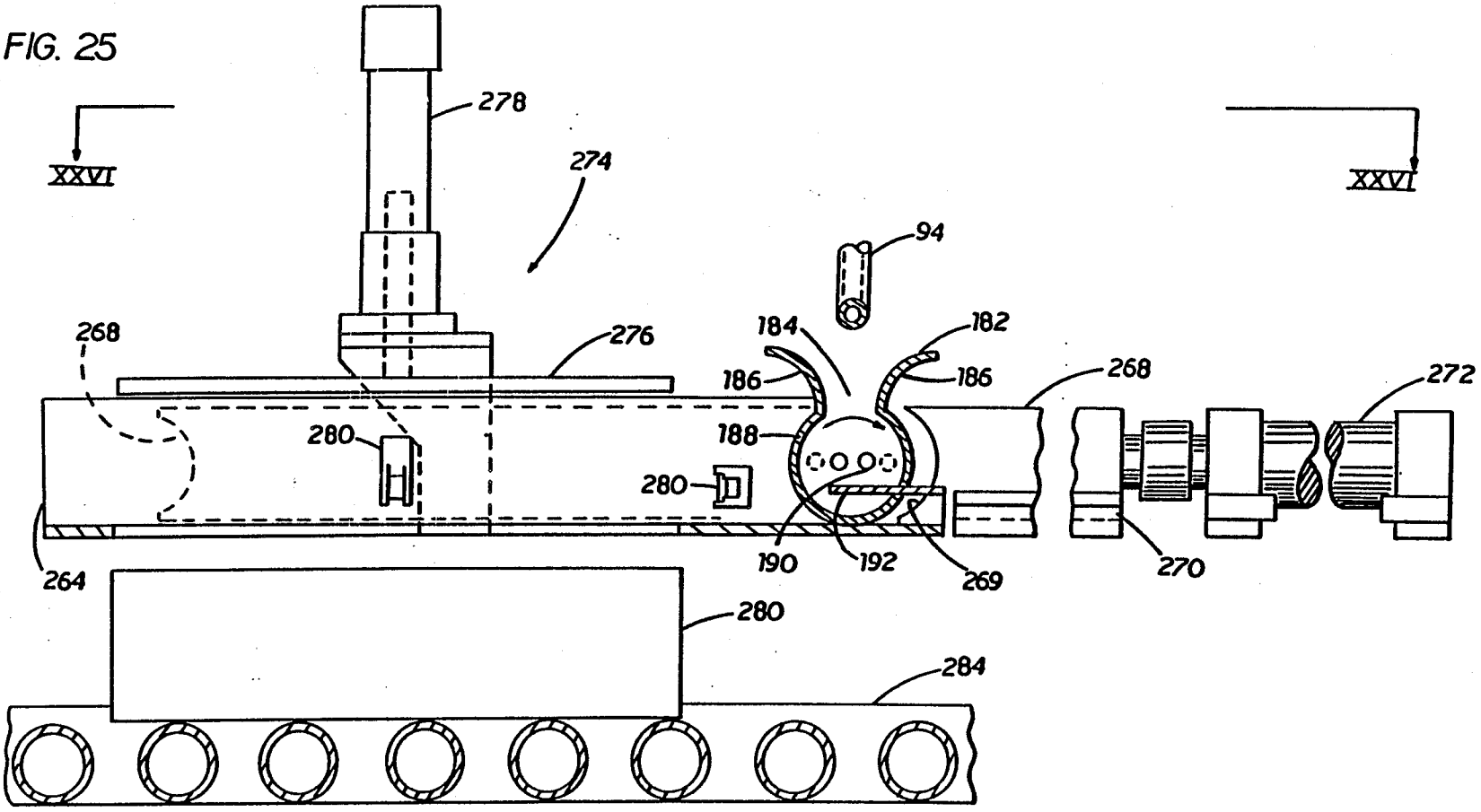
FIG. 25 is an elevational view taken along the lines XXV—XXV in FIG. 24.
Figure 26:
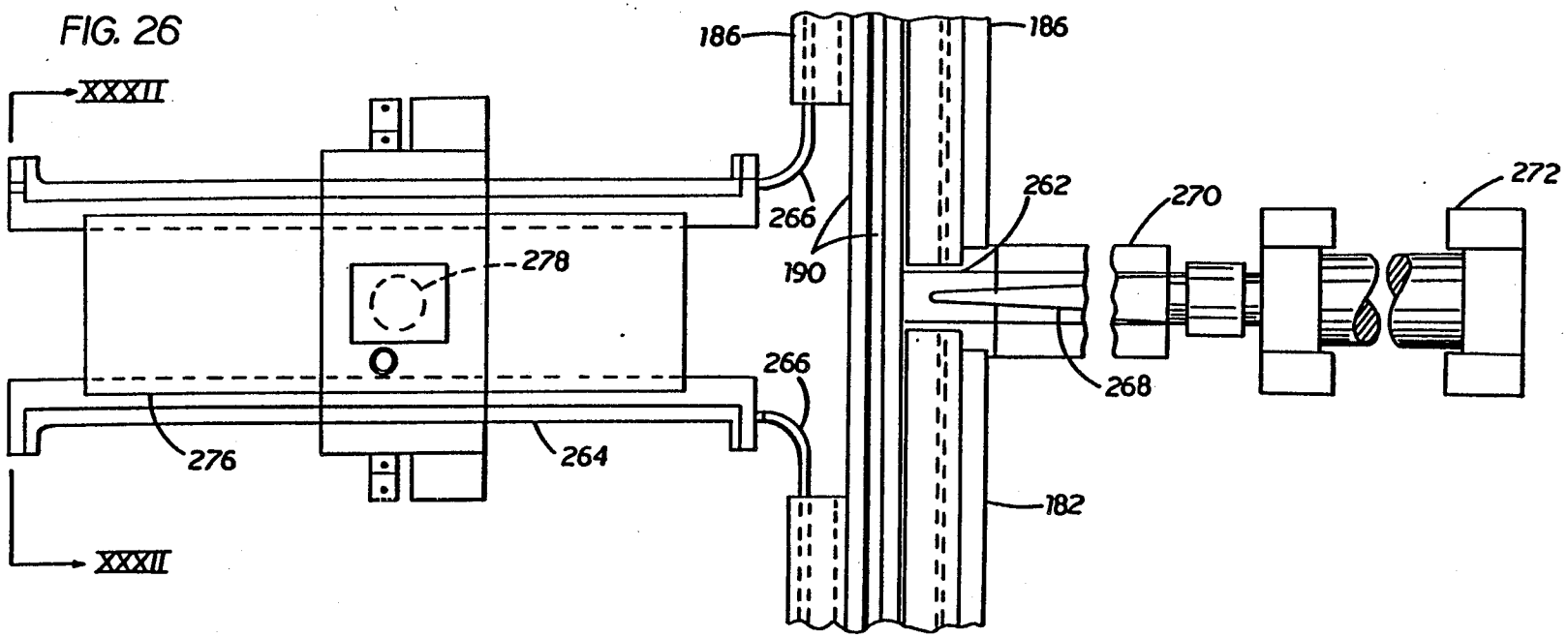
FIG. 26 is a partial plan view along the lines XXVI—XXVI in FIG. 25.

As the batch of nested bags drops from the downwardly vertically extending mandrel 94, it enters bag wrapping and folding system 46 (FIGS. 24–32). Bag wrapping and folding system 46 includes an elongated tubular enclosure 182 having a length which extends the full width of mandrel 94 and having an upwardly facing opening 184 bordered by a pair of outwardly diverging wings 186 (FIG. 25). Positioned within a central body 188 of tubular enclosure 182 is a pair of spring steel wrapping rods 190 which are elongated and extend the full length of tubular enclosure 182. Positioned below wrapping rods 190 is a bag guide 192 made of spring steel and also extending the full length of tubular enclosure 182.

Means are provided for laterally separating and bringing together wrapping rods 190. Means are additionally provided for rotating the wrapping rods 190 about a central axis that extends longitudinally along body 188 of tubular enclosure 182. In its rest position, awaiting a batch of nested bags, wrapping rods 190 are mutually horizontally oriented and separated from each other. As the batch of bags drops from mandrel 94 the leading end of the bags is guided by wings 186 to a position between the wrapping rods. The leading end engages bag guide 192 which supports the end of the batch of bags. In response to the batch beginning to move from mandrel 94, the wrapping rod separating means causes the wrapping rods to laterally move toward each other and grasp the end of the batch of bags. The wrapping rods rotating means is then actuated to cause the wrapping rods to orbit around a mutually central axes thus wrapping the batch of nested bags into a tube. During this wrapping process, bag guide 192 deflects as the roll of bags grows and keeps the bags tight on the roll. After the rotating means has made a predetermined number of revolutions, as monitored by proximity sensor 219 (FIGS. 27 and 28), the roll will be completely formed and the wrapping rods rotating means is deenergized. Proximity sensor 219 also senses the position of the wrapping rods and causes the wrapping rods rotating means to stop with the wrapping rods 190 in a horizontal orientation.

Figure 27:
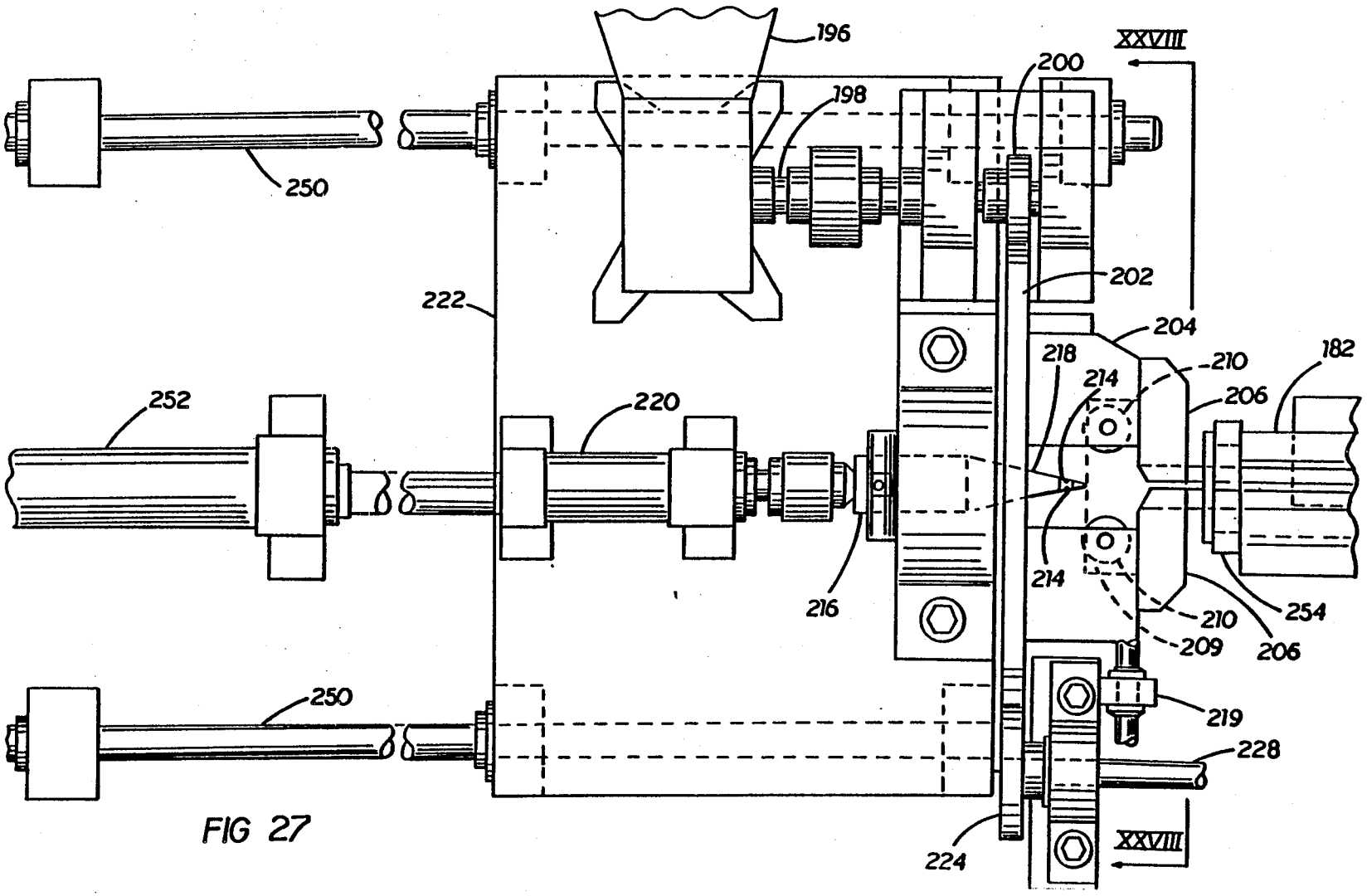
FIG. 27 is a plan view of the primary drive portion of the bag wrapping mechanism.
Figure 28:
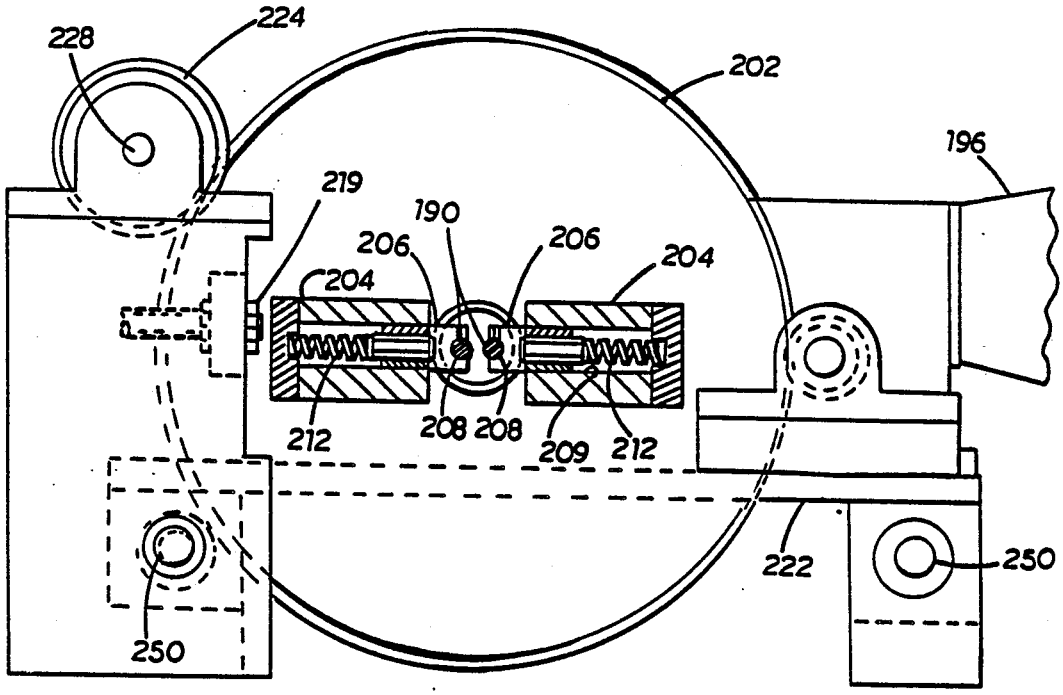
FIG. 28 is a sectional view taken along the lines XXVIII—XXVIII in FIG. 27.

The means for rotating the wrapping rods includes a motor/clutch/brake assembly 196 connected through a shaft 198 and a pinion gear 200 to a primary drive gear 202 (FIGS. 27 and 28). Primary drive gear 202 engages wrapping rods 190 through a housing 204 attached to gear 202 and a pair of wedge blocks 206 retained within housing 204. The laterally inward ends of wedge blocks 206 include indented surface 208 to engage wrapping rods 190, which are rigidly attached thereto as by welding. In this manner, as primary drive gear 202 is rotated by motor 196, the motion is transmitted to wrapping rods 190 through housing 204 and wedge blocks 206.

Wedge blocks 206 ride within a cavity 209 in housing 204 on bearings 210. Wedge blocks 206 are biased inwardly toward each other by springs 212. Wedge blocks 206 include outwardly facing diverging camming surfaces 214 outwardly of wrapping rods 190. Camming surfaces 214 are engaged by a longitudinally extendable dive wedge 216 having a conically pointed end surface 218. Dive wedge 216 is longitudinally movable by a pneumatic cylinder 220 mounted to a mounting plate 222. When cylinder 220 is extended, dive wedge 216 is moved against wedge blocks 206 and end surface 218 engages camming surfaces 214 of wedge blocks 206. As dive wedge 216 moves longitudinally, surfaces 214 are forced apart by the end surface 218 causing the wedge blocks to separate as they ride on bearings 210. The separation of wedge blocks 206 causes the wrapping rods 190 to move apart. Similarly, the retracting of cylinder 220 and hence the dive wedge, causes wrapping rods 190 to move together under the force of springs 212.

Figures 29, 30, 31:
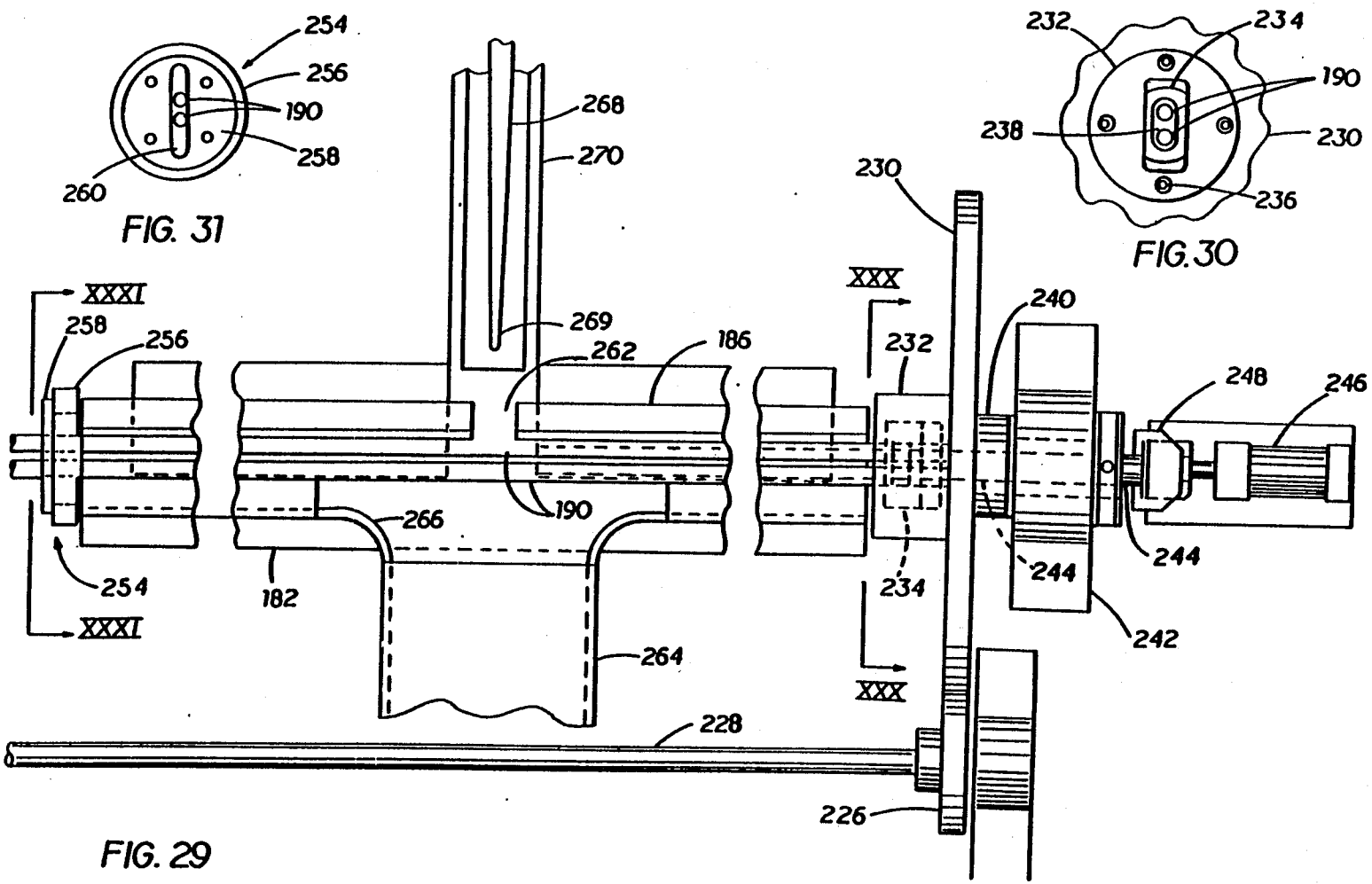
FIG. 29 is a plan view of the secondary drive portion of the bag wrapping mechanism.
FIG. 30 is a partial sectional view taken along the lines XXX—XXX in FIG. 29.
FIG. 31 is a partial sectional view taken along the lines XXXI—XXXI in FIG. 29.
Figure 32:
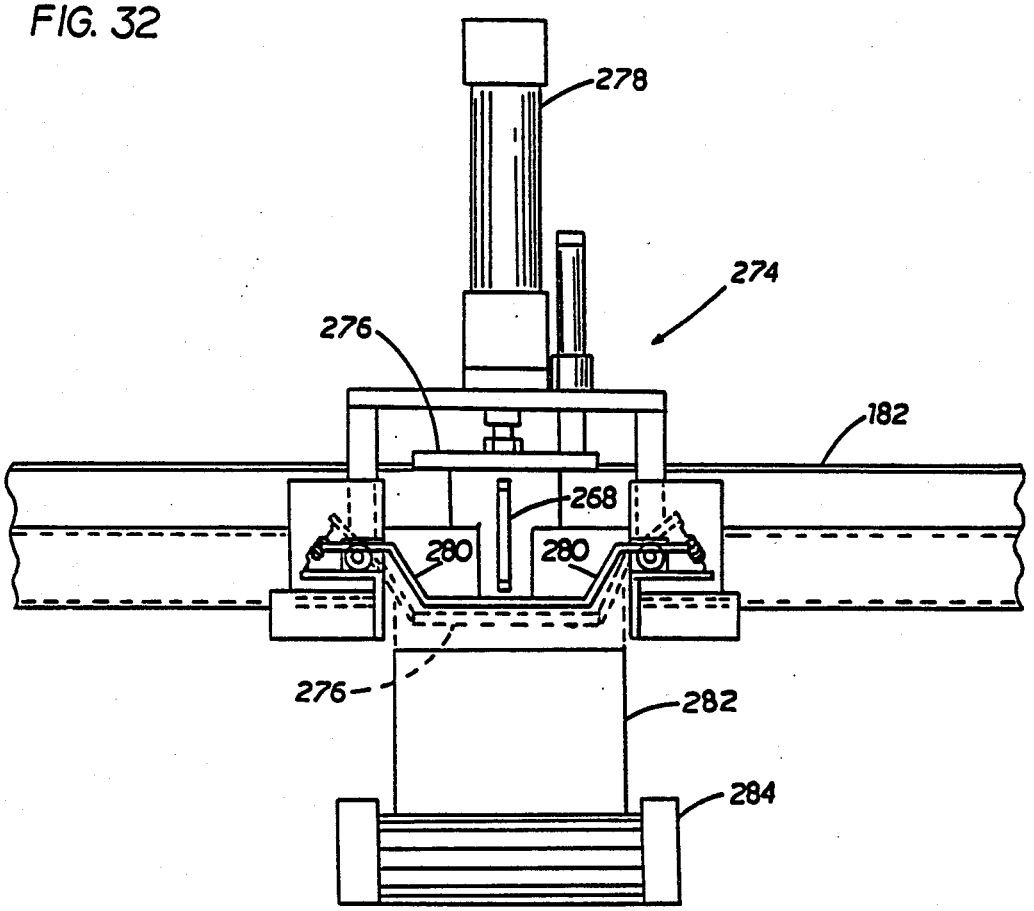
FIG. 32 is an elevational view taken along the lines XXXII—XXXII in FIG. 26.

A secondary pinion 224 engages primary drive gear 202 and is connected with a tertiary pinion 226 through a secondary drive shaft 228. Tertiary pinion 226 is, in turn, engaged with a secondary drive gear 230 which is interconnected with the opposite end of wrapping rods 190 to simultaneously drive the opposite ends in synchronism with the primary ends (FIGS. 29 and 30). The opposite ends of wrapping rods 190 are drivably engaged with secondary drive gear 230 through a retaining cup 232 attached to gear 230 and a slide member 234 longitudinally slidable with respect to wrapping rods 190 within a rectangular opening 236 in retaining cup 232. Slide member 234, in turn, includes an elongated cavity 238 for engaging the opposite ends of wrapping rods 190.

Drive gear 230 is rotatably journaled by a shaft 240 and a bearing block 242. The center of shaft 240 is hollowed and receives an elongated shaft 244 attached to and extending outwardly from slide member 234. The outward end of sliding member shaft 244 is engaged by a pneumatic cylinder 246 through a rotational slip coupling 248. When cylinder 246 is extended, shaft 244 is forced toward enclosure 182 by coupling 248 causing slide member 234 to engage the ends of wrapping rods 190 in cavity 238. Cavity 238 is configured to cause wrapping rods 190 to be closely spaced and serves to hold them in this configuration during the wrapping process. Additionally, slide member 234 rotates the ends of retaining rods 190 by its close engagement with rectangular opening 236 in retaining cup 232 which is mounted to secondary drive gear 230. When cylinder 246 is retracted, slide member 234 is moved out of engagement with wrapping rods 190. This allows the wrapping rods to be separated under the movement of dive wedge 216 and wedge blocks 206.

After the batch of nested bags has been wrapped into a roll within tubular enclosure 182, wrapping rods 190 are withdrawn from within the roll of bags as follows. Primary drive gear 202, wedge blocks 206 and wrapping rods 190 are attached to mounting plate 222 which is slidably mounted on a pair of tracks 250. Plate 222, and the items attached to plate 222 are movable along track 250 by a pneumatic cylinder 252. When cylinder 252 is in its extended position, as seen in FIG. 27, wrapping rods 190 are fully positioned within tubular enclosure 182. When cylinder 252 is retracted, it pulls mounting plate 222 to the left, as viewed in FIG. 27, which fully withdraws wrapping rods 190 from within enclosure 182. A stripping plate 254 is positioned on the end of tubular enclosure 182 adjacent wedge blocks 206 and includes a stationary portion 256 attached to enclosure 182 and a pair of mutually aligned disks 258, one of which is illustrated in FIG. 31, which are rotatable with respect to stationary portion 256. Each disk 258 includes a slot 260 through which wrapping rods 190 extend and which is elongated to accommodate the mutual relative movement of the rods. As wrapping rods 190 are withdrawn from enclosure 182 by the retracting of cylinder 252, disks 258 strip the roll of nested bags from the receding wrapping rods.

The centermost portion of tubular enclosure 182 includes a gap 262 in the wings 186 (FIG. 29). A tunnel 264 is positioned opposite gaps 262 and consists of an upwardly open U-shaped member which is interconnected with the walls of body 188 by rounded transition portions 266. A ram member 268 having a bluntly pointed tip 269 is mounted within a guide track 270 which is positioned in alignment with gap 262 perpendicular to the direction of elongation of tubular enclosure 182. Ram member 268 is elongated and longitudinally movable by a pneumatic cylinder 272. When cylinder 272 is retracted, ram member 268 is withdrawn from tubular enclosure 182. When cylinder 272 is extended, ram member 268 is longitudinally extended through gap 262 in enclosure 282 and into tunnel 264. The extension of ram member 268 in this manner, after the wrapping rods have been withdrawn from a roll of nested bags, deflects the center portion of the roll toward and into tunnel 264. Further extension of ram member 268 causes the roll of bags to deflect around transition portions 265 and to be positioned in tunnel 264 as a folded roll. Because ram member 268 has a blunted tip, the bags are not damaged by this motion.

When the ram member 268 is fully extended by cylinder 272, the entire roll of nested bags is doubled over and positioned within tunnel 264 under an ejection assembly 274. After being fully extended in this manner, ram member 268 is fully withdrawn by cylinder 272 until the next roll of nested bags is formed. After the cylinder 272 is retracted, the wrapping rods 190 are again inserted in tubular enclosure 182 by extension of cylinder 252 and the wrapping rods are separated by extension of cylinder 220. The bag wrapping and folding system is now ready for receipt of the next batch of bags from a mandrel 94.

Ejection assembly 274 includes an ejection plate 276 positioned above tunnel 264 and a pneumatic cylinder 278 operatively connected to plate 276. Ejection assembly 274 further includes a plurality of spring-loaded retaining panels 280 mounted adjacent vertical walls of tunnel 264. As ram member 268 pushes a folded roll of bags into tunnel 264, retaining panels 280 retain the roll in position under ejection plate 276. The bottom floor of tunnel 264 is open immediately below ejection plate 276 in order to allow folded rolls of bags to be ejected by ejection assembly 274 into an awaiting box 282 positioned under tunnel 264 by a powered conveyor 284 or the like. Box 282 and conveyor 284 may be replaced by other forms of receiving receptacles. After ejection plate 276 forces the folded roll of bags into waiting box 282, cylinder 278 is then retracted to withdraw ejection plate 276 to the position illustrated in FIG. 25 where it awaits the next folded roll of bags.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows.

1. A method of manufacturing nested polymeric bags comprising the steps of:

supplying polymeric tube in the form of a web;

seaming said tube transverse to said web at locations along said web that are spaced apart a predetermined distance;

severing said web into individual bags adjacent the seams;

transporting a predetermined number of bags seriatum onto a mandrel to form a batch of nested bags; and removing a batch of nested bags from said mandrel by indexing said mandrel to a downwardly facing vertical orientation so that said batch is removed from said mandrel by gravity.

2. The method in claim 1 wherein said step of removing further includes ejecting compressed air from said mandrel against the batch.

3. A method of manufacturing nested polymeric bags comprising the steps of:

supplying polymeric tube in the form of a web;

seaming said tube transverse to said web at locations along said web that are spaced apart a predetermined distance;

severing said web into individual bags adjacent the seams;

positioning substantially the entire length of a predetermined number of bags seriatum over a mandrel to form outwardly of said mandrel a batch of nested bags; and removing a batch of nested bags from said mandrel.

4. The method in claim 3 wherein said step of transporting includes advancing said web by transporting each bag before said step of severing.

5. The method in claim 3 wherein said step of severing includes separating the walls of said tubing.

6. The method in claim 3 further including rolling said batch of nested bags into a roll of bags.

7. The method in claim 6 wherein said step of rolling includes providing a pair of elongated wrapping rods transverse the batch, grasping an end of the batch between said rods and rotating said rods about an axis that is parallel to and located between said rods.

8. The method in claim 7 further including longitudinally withdrawing said rods from the roll of bags after said step of rolling.

9. A method of manufacturing nested polymeric bags comprising the steps of:

supplying polymeric tube in the form of a web;

seaming said tube transverse to said web at locations along said web that are spaced apart a predetermined distance;

severing said web into individual bags adjacent the seams;

transporting a predetermined number of bags seriatum onto a mandrel to form a batch of nested bags;

removing a batch of nested bags from said mandrel;

rolling said batch of nested bags into a roll of bags including providing a pair of elongated wrapping rods transverse the batch, grasping an end of the batch between said rods and rotating said rods about an axis that is parallel to and located between said rods;

longitudinally withdrawing said rods from the roll of bags after said step of rolling; and folding said roll along its longitudinal axis by placing a force on a central portion of said roll.

10. The method in claim 9 wherein said step of folding further includes repositioning said roll between a pair of spaced apart walls.

11. The method in claim 10 further including ejecting the folded roll from between said walls.

12. The method in claim 11 wherein said step of ejecting includes positioning the folded roll into a container.

13. An apparatus for manufacturing nested polymeric bags comprising:

material feeding means for feeding a web of material having a tubular cross-sectional configuration;

seaming means for forming a seam transverse the web;

a generally planar mandrel having a width smaller than a width of the web;

material transporting means between said seaming means and said mandrel for repeatedly transporting a portion of the seamed web onto said mandrel;

severing means between seaming means and said mandrel for severing the web into individual bags; and removing means for removing bags from said mandrel.

14. The apparatus in claim 13 further including separating means between said seaming means and said transporting means for separating opposing walls of the web.

15. The apparatus in claim 13 including a plurality of mandrels extending radially outwardly from an axle and indexing means for indexing said axle.

16. The apparatus in claim 13 further including rolling means positioned in relationship to said mandrel to receive a batch of nested bags removed from said mandrel for rolling the batch of nested bags into a roll.

17. The apparatus in claim 14 in which said transporting means includes a pair of fingers configured to grasp the interior of a web whose walls are separated by said separating means and conveying means for conveying said fingers over said mandrel.

18. The apparatus in claim 17 in which said transporting means further includes means for moving said fingers toward each other when entering the interior of a web and for moving said fingers away from each other when fully within a web.

19. The apparatus in claim 18 in which said transporting means further includes means for moving said fingers away from each other when the web is over said mandrel.

20. The apparatus in claim 17 in which said conveying means includes means for conveying said fingers a first predetermined distance to position a seam adjacent said severing means and for conveying said fingers a second predetermined distance after a bag is severed from a web by said severing means.

21. The apparatus in claim 20 in which said conveying means includes a pair of extendable cylinders mounted longitudinally back-to-back.

22. The apparatus in claim 16 in which said rolling means includes receiving means for receiving an end of a batch of bags that is removed from said mandrel by said removing means, a parallel pair of elongated wrapping rods positioned to receive the end of the batch of bags from said receiving and rotating means for rotating said rods about an axis that is parallel to and located between said rods.

23. The apparatus in claim 22 in which said rolling means further includes positioning means for selectively positioning said rods either together or spaced apart.

24. The apparatus in claim 22 in which said rotating means includes means for rotating both ends of said rods.

25. The apparatus in claim 22 in which said rolling means further includes withdrawing means for withdrawing said rods from said receiving means.

26. An apparatus for manufacturing nested polymeric bags comprising:

material feeding means for feeding a web of material having a tubular cross-sectional configuration;

seaming means for forming a seam transverse the web;

a plurality of generally planar mandrels extending radially outwardly from an axle and indexing means for indexing said axle, wherein each of said mandrels has a width smaller than a width of the web and each of said mandrels includes a perforated tube;

material transporting means between said seaming means and said mandrel for repeatedly transporting a portion of the seamed web onto said mandrel;

severing means between seaming means and said mandrel for severing the web into individual bags;

receiving means for receiving an end of a batch of bags; and removing means for removing bags from said mandrel including means for applying compressed air to said tube when the respective mandrel is indexed to a position adjacent said receiving means.

27. An apparatus for manufacturing nested polymeric bags comprising:

material feeding means for feeding a web of material having a tubular cross-sectional configuration;

seaming means for forming a seam transverse the web;

a generally planar mandrel having a width smaller than a width of the web;

material transporting means between said seaming means and said mandrel for repeatedly transporting a portion of the seamed web onto said mandrel;

severing means between seaming means and said mandrel for severing the web into individual bags;

removing means for removing bags from said mandrel; and rolling means positioned in relationship to said mandrel to receive a batch of nested bags removed from said mandrel for rolling the batch of nested bags into a roll, said rolling means including receiving means for receiving an end of a batch of bags that is removed from said mandrel by said removing means, a parallel pair of elongated wrapping rods positioned to receive the end of the batch of bags from said receiving, rotating means for rotating said rods about an axis that is parallel to and located between said rods, said rolling means further including positioning means for selectively positioning said rods either together or spaced apart, said positioning means including biasing means for biasing first ends of said rods together and wedge means selectively longitudinally movable toward and away from said ends for forcing said ends apart to space said rods apart and for allowing said biasing means to bias said ends together to position said rods together.

28. The apparatus in claim 27 in which said positioning means further includes retaining means for retaining ends of said rods opposite said first ends together when said wedge means is allowing said biasing means to bias said first ends together.

29. An apparatus for manufacturing nested polymeric bags comprising:

material feeding means for feeding a web of material having a tubular cross-sectional configuration;

seaming means for forming a seam transverse the web;

a generally planar mandrel having a width smaller than a width of the web;

material transporting means between said seaming means and said mandrel for repeatedly transporting a portion of the seamed web onto said mandrel;

severing means between seaming means and said mandrel for severing the web into individual bags;

removing means for removing bags from said mandrel; and separating means between said seaming means and said transporting means for separating opposing walls of the web, said separating means including first and second perforated bars and means for drawing a vacuum on said bars.

30. The apparatus in claim 29 in which said severing means includes a knife extending the width of the web, mounting means for mounting said knife transverse said web and extending means for extending said knife across said web and in which said first bar is attached to said knife such that one wall of the web will adhere to said first bar when said extending means is extending said knife and will separate from the other wall when said extending means is retracting said knife.

31. An apparatus for manufacturing nested polymeric bags comprising:

material feeding means for feeding a web of material having a tubular cross-sectional configuration;

seaming means for forming a seam transverse the web;

a generally planar mandrel having a width smaller than a width of the web;

material transporting means between said seaming means and said mandrel for repeatedly transporting a portion of the seamed web onto said mandrel;

severing means between seaming means and said mandrel for severing the web into individual bags;

removing means for removing bags from said mandrel;

rolling means positioned in relationship to said mandrel to receive a batch of nested bags removed from said mandrel for rolling the batch of nested bags into a roll, said rolling means including receiving means for receiving an end of a batch of bags that is removed from said mandrel by said removing means, a parallel pair of elongated wrapping rods positioned to receive the end of the batch of bags from said receiving and rotating means for rotating said rods about an axis that is parallel to and located between said rods, said rolling means further including withdrawing means for withdrawing said rods from said receiving means and positioning means for selectively positioning said rods either together or spaced apart, wherein said positioning means and rotating means are mounted to a platform and further wherein said withdrawing means includes means for moving said platform away from said receiving means.

32. The apparatus in claim 31 including sensing means for sensing the position of said rods and causing said rotating means to position said rods at a predetermined orientation when said rotating means is not rotating said rods.

33. The apparatus in claim 31 further including folding means for folding a roll of nested bags along the longitudinal axis of said roll.

34. The apparatus in claim 33 in which said folding means includes a central gap in said receiving means, ram means extending through said gap for applying a force against the longitudinal central portion of a roll of bags and a tunnel having a pair of spaced walls extending opposite said ram means, said ram means being extendable through said gap and into said tunnel to move the roll of bags into the tunnel while simultaneously folding them.

35. The apparatus in claim 34 further including ejecting means for ejecting a folded roll of bags from said tunnel.

36. An apparatus for manufacturing nested polyethylene bags comprising:

means for manufacturing a plurality of nested bags on a mandrel;

removing means for removing bags from said mandrel including means for positioning said mandrel in a downwardly facing vertical orientation; and rolling means for rolling a batch of nested bags into a roll including receiving means for receiving an end of a batch of bags removed from said mandrel by said removing means, a parallel pair of elongated wrapping rods positioned to receive the end of the batch of bags from said receiving means and rotating means for rotating said rods about an axis that is parallel to and located between said rods.

37. The apparatus in claim 36 in which said rolling means further includes positioning means for selectively positioning said rods either together or spaced apart.

38. The apparatus in claim 36 in which said rotating means includes means for rotating opposite ends of said rods.

39. The apparatus in claim 36 in which said rolling means further includes withdrawing means for withdrawing said rods from said receiving means.

40. An apparatus for manufacturing nested polyethylene bags comprising:

means for manufacturing a plurality of nested bags on a mandrel;

removing means for removing bags from said mandrel; and rolling means for rolling a batch of nested bags into a roll including receiving means for receiving an end of a batch of bags removed from said mandrel by said removing means, a parallel pair of elongated wrapping rods positioned to receive the end of the batch of bags from said receiving means and rotating means for rotating said rods about an axis that is parallel to and located between said rods, said rolling means further including positioning means for selectively positioning said rods either together or spaced apart, said positioning means including biasing means for biasing first ends of said rods together and wedge means longitudinally movable toward and away from said ends for forcing said ends apart to space said rods apart and for allowing said biasing means to bias said ends together to position said rods together.

41. The apparatus in claim 40 in which said positioning means further includes retaining means for retaining opposite ends of said rods together when said wedge means is allowing said biasing means to bias said ends together.

42. An apparatus for manufacturing nested polyethylene bags comprising:

means for manufacturing a plurality of nested bags on a mandrel;

removing means for removing bags from said mandrel; and rolling means for rolling a batch of nested bags into a roll including receiving means for receiving an end of a batch of bags removed from said mandrel by said removing means, a parallel pair of elongated wrapping rods positioned to receive the end of the batch of bags from said receiving means and rotating means for rotating said rods about an axis that is parallel to and located between said rods, said rolling means further including positioning means for selectively positioning said rods either together or spaced apart and withdrawing means for withdrawing said rods from said receiving means, wherein said positioning means and rotating means are mounted to a platform and further wherein said withdrawing means includes means for moving said platform away from said receiving means.

43. An apparatus for manufacturing nested polyethylene bags comprising:

means for manufacturing a plurality of nested bags on a mandrel;

removing means for removing bags from said mandrel;

rolling means for rolling a batch of nested bags into a roll including receiving means for receiving an end of a batch of bags removed from said mandrel by said removing means, a parallel pair of elongated wrapping rods positioned to receive the end of the batch of bags from said receiving means and rotating means for rotating said rods about an axis that is parallel to and located between said rods; and sensing means for sensing the position of said rods and for causing said rotating means to position said rods at a predetermined orientation when said rotating means is not rotating.

44. The apparatus of claim 43 further including guide means below said wrapping rods for properly positioning an end of a batch of bags between said rods.

45. The apparatus in claim 43 including an elongated enclosure around said wrapping rods and in which said receiving means comprises edge means defining a longitudinally extending slit in said opening and outwardly laterally diverging wing members extending from said edge means.

46. An apparatus for manufacturing nested polyethylene bags comprising:

means for manufacturing a plurality of nested bags on a mandrel;

removing for removing bags from said mandrel;

rolling means for rolling a batch of nested bags into a roll including receiving means for receiving an end of a batch of bags removed from said mandrel by said removing means, a parallel pair of elongated wrapping rods positioned to receive the end of the batch of bags from said receiving means and rotating means for rotating said rods about an axis that is parallel to and located between said rods, said rolling means further including withdrawing means for withdrawing said rods from said receiving means; and folding means for folding a roll of nested bags along the longitudinal axis of said roll.

47. The apparatus in claim 46 in which said folding means includes a central gap in said receiving means, ram means extending through said gap for applying a force against the longitudinal central portion of a roll of bags and a tunnel having a pair of spaced walls extending opposite said ram means, said ram means being extendable through said gap and into said tunnel to move the roll of bags into the tunnel while simultaneously folding them.

48. The apparatus in claim 47 further including ejecting means for ejecting a folded roll of bags from said tunnel.

* * * * *

UNITED STATES PATENT AND TRADEMARK OFFICE

CERTIFICATE OF CORRECTION

PATENT NO. : 4,905,453

DATED : March 6, 1990

INVENTOR(S) : Barton G. Siebring

It is certified that error appears in the above-identified patent and that said Letters Patent is hereby corrected as shown below:

Column 16, Claim 46, Line 5:
After "removing" insert --means--.

Signed and Sealed this

Eighteenth Day of February, 1992

*Attest:*

HARRY F. MANBECK, JR.

*Attesting Officer*

*Commissioner of Patents and Trademarks*